United States Patent [19]

Hough

[11] 4,277,066

[45] Jul. 7, 1981

[54] GAME APPARATUS

[76] Inventor: Sherman C. Hough, 30547 Blairmoor, Madison Heights, Mich. 48071

[21] Appl. No.: 205,312

[22] Filed: Nov. 10, 1980

[51] Int. Cl.[3] ..... A63F 3/00

[52] U.S. Cl. ..... 273/267

[58] Field of Search ..... 273/267, 275

[56] References Cited

U.S. PATENT DOCUMENTS

| | | | |
|---|---|---|---|
| 429,250 | 6/1890 | Sperl | 273/267 |
| 2,766,987 | 10/1956 | Seelbrede | 273/267 |
| 3,024,026 | 3/1962 | Goetz | 273/275 |
| 3,768,811 | 10/1973 | Goldfarb | 273/267 X |
| 3,863,926 | 2/1975 | White | 273/267 |
| 3,948,524 | 4/1976 | Ladd | 273/267 X |

FOREIGN PATENT DOCUMENTS

| | | | |
|---|---|---|---|
| 758568 | 10/1956 | United Kingdom | 273/267 |
| 1103337 | 2/1968 | United Kingdom | 273/267 |

*Primary Examiner*—Harland S. Skogquist

*Attorney, Agent, or Firm*—Fisher, Gerhardt, Crampton & Groh

[57] ABSTRACT

Game apparatus including a board and playing cards in which the board forms a grid of squares with the four sides of each square being identified by a different color and with the colors so arranged that the same color is not employed to identify contiguous sides of a square. Side marker elements are used to establish and define the sides of squares, as determined by the play of cards having corresponding colors. The establishment of the last or fourth side of any square establishes a score for the player making the play.

9 Claims, 7 Drawing Figures

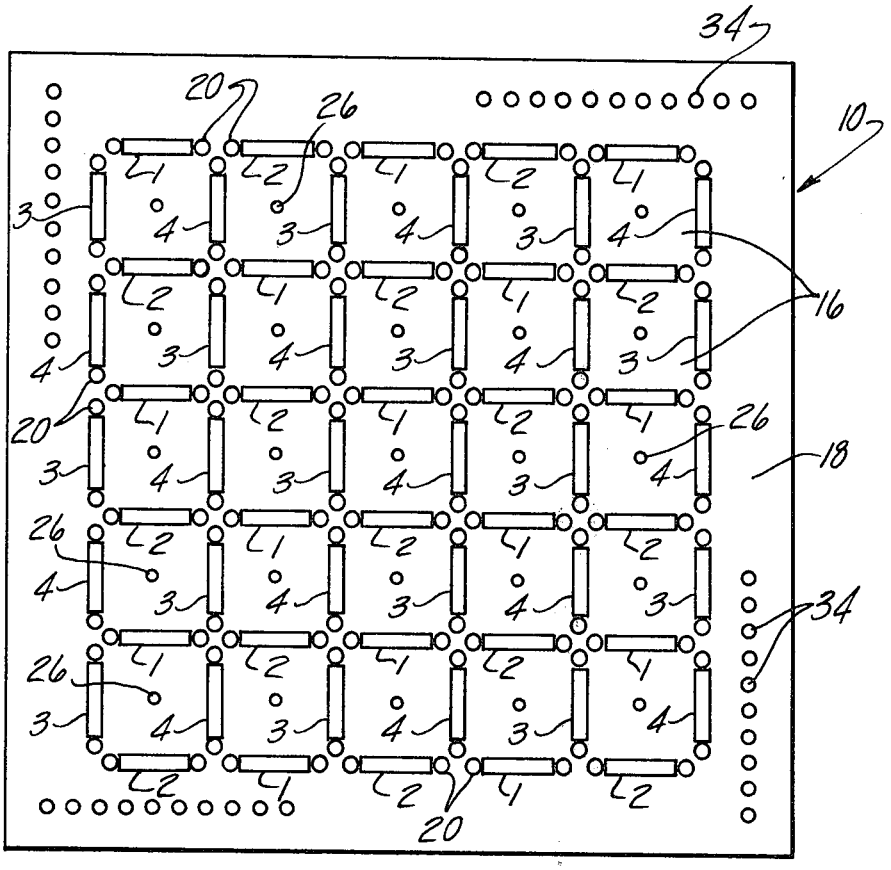
Fig-1
Fig-2
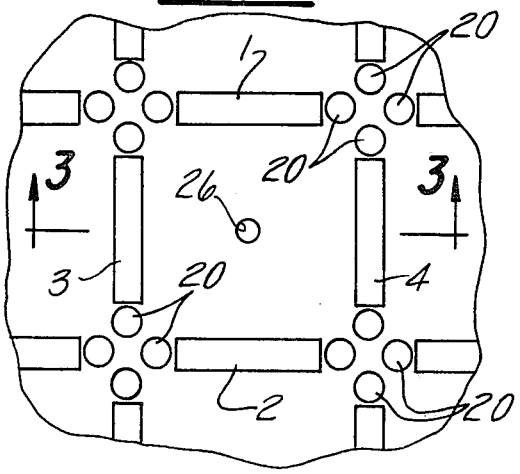
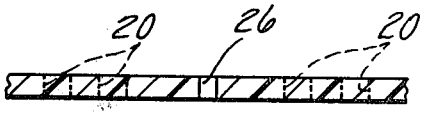
Fig-3
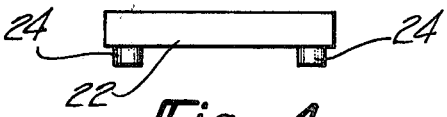
Fig-4
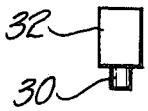
Fig-5
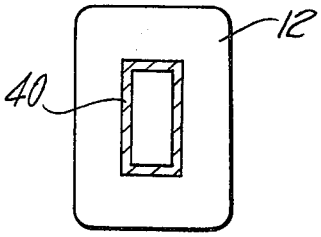
Fig-6
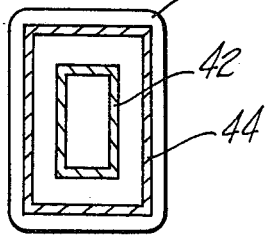
Fig-7

GAME APPARATUS

This invention relates to game apparatus for two, three or four players the object of which is to capture squares in accordance with the play of special cards.

Games in which the object is to capture and claim squares have been played for many years in which the sides of squares are defined by successive players so that upon completion of a given square, the player defining the last side gets credit and therefore a score for his play.

It is the object of the present invention to provide a game which involves establishing the sides and capturing of squares but in which the defining of sides of a square is determined by the play of cards.

Another object of the invention is to provide game apparatus for the play of game in which the aspects of chance are minimized by arranging a game board and cards in such a manner that the indicia representing different positions on the board are equal in number so that no preference is given to a particular indicia.

The objects of the invention are accomplished by a game apparatus which includes a board and playing cards. The board has a flat playing surface with a plurality of square playing areas with each of the square playing areas defined by four sides. The indicia defining the sides can take different forms but preferably color is used. A plurality of cards also are used, each of which has a marking indicating at least one of the sides of the squares. The sides designated on the cards are equal in number to the sides on the board. Also, the sides are so identified that the four lines defining its perimeter are each of a different color. In addition, the indicia or colors defining the sides are so arranged that no two colors are contiguous to each other. Side markers or fences are provided so that during the play of the game, the players mark a side of a square in accordance with the play of a card and ultimately the player who marks the fourth side of a square can claim it as his own for a score. The strategy involved in the game includes not only the placement of fences identifying the sides of squares but also the play of the cards in such a manner that in the final stages of the game, the player has an arrangement of cards which will permit him to capture more than one square in a single play.

These and other objects of the invention will become apparent from the following description and from the drawings in which:

FIG. 1 is a plan view of a game board forming part of the game apparatus embodying the invention;

FIG. 2 is a broken-away enlarged view of a portion of the game board seen in FIG. 1;

FIG. 3 is a cross-sectional view taken on line 3—3 in FIG. 2;

FIG. 4 is a view of a fence element used to identify the sides of a square during the play of the game;

FIG. 5 is a marker used to identify a player of the game;

FIG. 6 is a view of the face of a playing card forming part of the game apparatus;

FIG. 7 is a view of a face of another form of playing card used in the play of the game.

Referring to the drawings, the invention is embodied in a game board designated generally at 10 and a deck of cards, two of which are designated at 12 and 14 in FIGS. 6 and 7, respectively.

The board 10 has a flat playing surface on which a grid of a plurality of squares or playing areas 16 is defined by lines of different colors. In the preferred embodiment of the invention, the board has twenty five squares 16 surrounded by a border 18. The sides of each square are defined by a line of a different color, for example, red, blue, yellow and green which are designated in the drawings by the numbers 1, 2, 3 and 4, respectively. Not only does each square have its four sides designated by four different colors, but also it is preferred that contiguous sides are not identified by the same color. This requires that the colors be arranged in a particular order as shown in FIG. 1. By way of example, with a board made up of twenty five squares, there are a total of sixty sides requiring fifteen sides of each of the four colors being used.

Each side of each square is provided with a pair of holes 20 at the ends of the lines defining each side. The apparatus also includes a plurality of side marker or fence elements 22 as seen in FIG. 4, each of which has a length corresponding substantially to the length of the sides of the squares and the ends are provided with dowel portions 24 spaced apart the same distance as the holes 20. During the course of play with the apparatus, the fence elements 22 are placed in position on a square selected by the players in accordance with the play of a card by that particular player. The number of fence elements 22 is equal to the number of sides of squares 16 on the board, that is, with twenty five squares there are sixty sides and fence elements 22.

Each of the playing areas defined by a square 16 also is provided with an opening 26 which is adapted to receive a complementary dowel 30 of a marker 32 which also may be color coded to designate and identify a player. As in the play of the usual game of squares, the markers 32 are placed in position in a playing area 16 at that time that the fourth fence element 22 is placed in position around any given square and is used to keep account of the various squares captured or possessed by a given player. The border 18 of the board 10 is also provided with a number of openings 34 in which the various players can store markers 32 that are not in play.

The game apparatus also includes a deck of cards made up of cards 12 and 14 shown in FIGS. 6 and 7. Preferably, the game apparatus includes a deck of fifty-two cards of which forty-four cards are of the type shown in FIG. 6 and eight of the type shown in FIG. 7. The cards 12 seen in FIG. 6 each have a display at 40 of a single color corresponding to one of the colors used to identify a side of a square or playing surface 16. Of the forty-four cards, there are four groups of eleven cards with each of the four groups displaying one of the four colors used to identify sides of squares on the playing board 10.

The card 14 seen in FIG. 7 displays two different colors at 42 and 44. Since there are forty-four sides of squares identified in the four groups of cards of the type seen in FIG. 6, the remaining sixteen sides of the squares are identified on the eight remaining cards of a fifth group of cards. Since there are fifteen sides of each color and eleven sides are identified on the cards of FIG. 6, this requires that the eight cards of the type shown in FIG. 7 identify the remaining sixteen sides by displaying four sides of each color. Preferably each of the cards of FIG. 7 displays two different colors and a desirable color arrangement and balance can be obtained by providing two cards displaying a red and yellow line, two cards dislaying a red and blue line, two cards displaying a green and blue line and two cards displaying a green and yellow line.

The game apparatus can be used by two, three or four players. The game is begun by one of the players shuffling and dealing five cards to each player and placing the remaining thirty-two cards face down. The first player selects a card from his hand displaying the color line corresponding to one of the four sides of a square on which he wishes to place a fence element 22. After positioning a fence element 22, the player discards the selected card and draws a new card from the top of the deck of thirty-two cards. Each player, in turn, plays in the same manner until eventually a player can complete the fourth side of a square playing surface and can claim it as his by placing his color marker 32 in the hole 26 identifying the square which has been completely fenced. When the last of the cards from the stack has been drawn by one of the players, the play continues from the five cards remaining in the hands of each of the players until all of the cards have been played and returned to the discard pile. Since the object of the game is to claim as many squares as possible, the strategy of the game includes arranging the final five cards of the player's hand in the final stages of the game so that it will be possible to claim multiple squares with the single play of a card.

It will be apparent that the game apparatus including the board 10 and the cards 12 and 14 can be varied in arrangement and number. However, it has been found that a game board containing twenty-five squares is preferable since it makes it possible to maintain the number of cards 12 and 14 and the number of fence elements 22 at a manageable number. No matter how many squares are employed in the game apparatus, it is found preferable for the purposes of strategy of playing the game to have each square identified by four different sides or colors. Also, it is preferable for the colors to be arranged in a uniform rather than a random manner so that no advantage is given to any particular indicia designating a side of a square. To accomplish this it has been found desirable to insure that each square is identified by four separate colors and that no two colors are contiguous to each other.

The game apparatus has been provided in which a game can be played which requires strategic planning and decisions displaying skill with the aspect of luck or chance minimized but at the same time providing variety and interest. The apparatus for the player of the game is simple in form and is convenient to use and to store.

The embodiments of the invention in which an exclusive property or privilege is claimed are defined as follows:

1. Game apparatus comprising: a board having a flat playing surface with a plurality of square playing areas, each of said playing areas having sides designated by four different indicia, a plurality of cards, each having a marking indicating at least one of the sides of each of said squares, said sides designated on said cards being equal in number to the number of sides designated on said board, a plurality of fence elements for disposition on the board in a position on a selected side of a selected square in accordance with the play of a card having a marking corresponding to the indicia of the selected side of said selected square, four of said fence elements being required to surround a square, and player identifying markers coded to identify each player, said markers being disposed within each square upon disposing the fourth fence element in position to surround a given square.

2. The game apparatus of claim 1 wherein indicia indicating the sides of said squares are so arranged that identical indicia are never contiguous of each other.

3. The game apparatus of claim 1 wherein four groups of cards of said plurality of cards are equal in number and wherein all cards of a group have identical indicia identifying a single side of said square playing areas.

4. The game apparatus of claim 3 and further comprising a fifth group of cards having indicia identifying two different sides of said square playing areas.

5. The game apparatus of claim 4 wherein each group of said four groups consist of eleven cards and wherein said fifth group consists of eight cards.

6. The game apparatus of claim 1 wherein the sides of square playing areas are partially defined by a pair of holes in said board at each end of each side, said fence elements each having a length equal to the sides and each having a pair of protrusions at opposite ends complementary to said pairs of holes.

7. The game apparatus of claim 1 wherein said player identifying markers include a peg and wherein each of said square playing areas is provided with a single opening to receive a peg.

8. The game apparatus of claim 1 wherein indicia identifying said sides on said board and said markings on said cards are colors.

9. The game apparatus of claim 7 wherein two colors defined said sides extend in one direction across said board and wherein the remaining two colors of lines extend transversely to said lines of said first two colors.

* * * * *